United States Patent [19]

Anderson et al.

[11] 3,973,374

[45] Aug. 10, 1976

[54] CLOSURE MECHANISM FOR FOOD TRAY COVERS

[75] Inventors: Andrew W. Anderson, West Caldwell; John P. Mullin, Scotch Plains, both of N.J.

[73] Assignee: Scandia Packaging Machinery Company, Clifton, N.J.

[22] Filed: Mar. 3, 1972

[21] Appl. No.: 231,589

[52] U.S. Cl. ..... 53/333

[51] Int. Cl.[2] ..... B65B 7/28

[58] Field of Search ..... 53/329, 333, 287, 345

[56] References Cited

UNITED STATES PATENTS 3,116,560 1/1964 Anderson ..... 53/329

3,138,906 6/1964 Anderson ..... 53/329 X

*Primary Examiner*—Travis S. McGehee

*Attorney, Agent, or Firm*—Neil F. Markva

[57] ABSTRACT

The closure mechanism includes means for tucking the trailing edge of a cover sheet beneath the trailing rim portion of a container at the opposed side rim portions of the container. A further mechanism is used to fold the remaining portion of the trailing edge of the cover sheet around the trailing rim portion of the container. A specific embodiment of the invention includes the use of two separate tucking elements laterally displaced with respect to each ther and a single folding element disposed therebetween. Means are provided to reciprocate the tucking and folding elements between a resting and working position.

6 Claims, 8 Drawing Figures

CLOSURE MECHANISM FOR FOOD TRAY COVERS

BACKGROUND OF THE INVENTION

This invention relates to a closure mechanism for folding flexible sheets of foil around the rim portion of a container. More particularly, the mechanism is used for closing covers of food tray containers such as are used for TV dinners. These containers are filled with food and covered with a flexible cover sheet of foil.

The apparatus of this invention is used in conjunction with an assembly for covering rimmed tray containers with foil sheets such as are disclosed in U.S. Pat. Nos. 2,889,675 and 2,948,096. Each of these patents discloses a mechanism for folding a flexible cover sheet around a leading rim portion and two opposing side rim portions with a subsequent folding apparatus for folding the trailing edge of the foil sheet as shown in those patents.

In U.S. Pat. No. 3,116,580, a single element is used to tuck and fold the trailing edge of a flexible cover sheet around the rim structure of a tray container. A basic disadvantage found associated with this structure is that the cover sheet, generally aluminum foil, is crushed against the under portion of the trailing rim. That is, there is a bunching effect and never any uniformity with regard to the folding of the foil around the rim structure. Without a neat folded configuration, the cover sheet is not tightly fitted in any uniform manner. Due to the non-uniformity and irregularity of the final folding operation, the sealing characteristics of the cover sheet over the tray container are therefore adversely affected.

Another problem found associated with such a crushing fold is related to the use of very thin foil sheets. Where thicker foil is used, the tightness of the fold depends somewhat upon the strength of the foil material itself. That is, a foil material having a one mil thickness is going to wrap more tightly than a foil having a thickness of about 0.0005 inch. It therefore becomes very important that a neat fold is effectuated along each side of the rimmed tray container because the residual strength of the thinner foils is not as effective in attaining the tightness of the seal around the rim of the container.

PURPOSE OF THE INVENTION

The primary object of this invention is to provide a practical and efficient means for folding the trailing edge of a cover sheet of foil around the trailing edge of a rimmed tray container.

Another object of the invention is to provide a folding mechanism which may be used to form uniform folds in extremely thin foil sheets while maintaining a tightly fit folded configuration.

A further feature of the invention is to overcome the disadvantages associated with the prior art structure.

SUMMARY OF THE INVENTION

The closure mechanism as disclosed herein includes a means for tucking the trailing edge of the cover sheet beneath the trailing rim portion of a container at the opposed side rim portions. A means is then provided for folding the remaining portion of the trailing edge of the cover sheet around the trailing rim portion of the container.

A specific feature of the invention is directed to the use of two separate tucking elements laterally displaced with respect to each other and means to reciprocate the tucking elements between a resting position and a tucking position.

Another feature is directed to the use of a single folding element and means to reciprocate the folding element between a resting position and a folding position.

In a specific embodiment of the invention, two separate tucking elements are used in combination with a single folding element which are pivotally mounted about the same axis of rotation. The single tucking element is disposed between the two separate tucking elements to effectuate the desired folding operation.

BRIEF DESCRIPTION OF DRAWINGS

Other features of this invention will appear in the following description and appended claims, reference being made to the accompanying drawings forming a part of the specification wherein like reference characters designate corresponding parts in the several views.

DESCRIPTION OF SPECIFIC EMBODIMENTS

Figure 1:
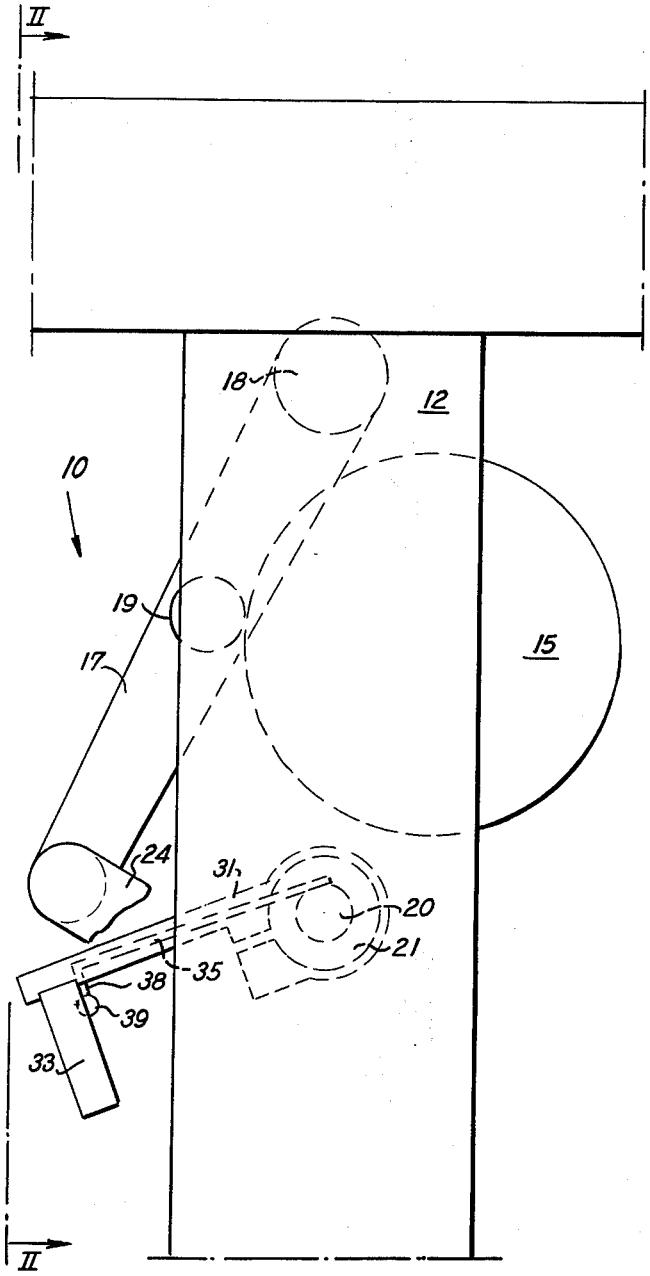
FIG. 1 is a side elevational view schematically showing a closure mechanism in a resting position.

More specifically, a closure mechanism, generally designated 10, is used for folding the trailing edge of a cover sheet S around the trailing rim B of a tray container C. The closure mechanism 10 includes two tucking elements 31 and a single folding element 35. The tucking elements 31 are laterally displaced with respect to each other and the folding element 35 is disposed between the two tucking elements 31. In this particular embodiment, the tucking elements 31 and folding element 35 share the same axis of rotation. The tucking elements are used to tuck the trailing edge of the cover sheet S beneath the trailing rim portion B at the opposed side rim portions of the container C. That is, a tucked portion is formed along each of the opposed side rim portions. The folding element 35 is used to fold the remaining portion of the trailing edge of the cover sheet S between the trailing rim portion B. In other words, a neatly folded portion is formed contiguously to each of the tucked portions. The folding element 35 acts sequentially on the trailing edge at a different period of time than the tucking elements 31 as discussed hereinbelow.

The tucking elements 31 are adjustably mounted on the tucking shaft 21 so that they may be properly aligned in a common plane and angularly adjusted with respect to the oscillatory movement of the shaft 21. Any desired clamp mechanism may be used to provide the adjustment means for the tucking members 31.

Figures 4, 5:
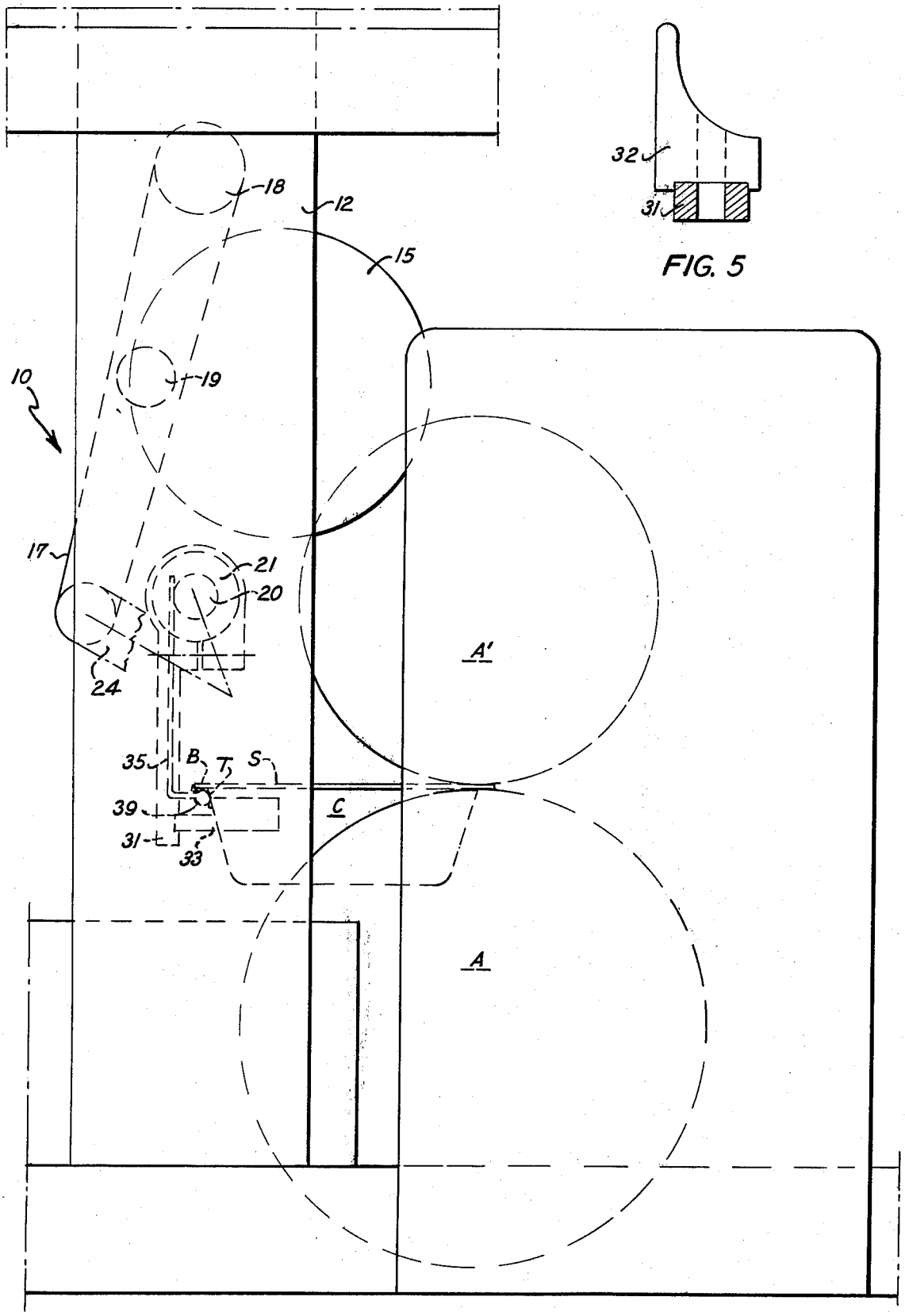
FIG. 4 is a side elevational view schematically showing the closure mechanism of FIG. 1 effecting the completed fold over the trailing edge of a cover sheet beneath the trailing rim portion of a container.
FIG. 5 is a sectional view along V—V of FIG. 2, and FIGS. 6 through 8 are fragmentary sectional views showing the sequential operation of the closure mechanism of FIG. 1 for tucking and folding the trailing end of a foil sheet underneath the trailing rim portion of a tray container.

Contoured tuckers 32 and 33 are fixedly mounted with fastening members 34 to the ends of the tucking elements 31. The tuckers 32 and 33 may be adjusted so that they may be aligned appropriately with the corners of the container C through the use of the slotted openings at the end of the tucker elements 31. As shown in FIG. 5, the tuckers 32 and 33 have an inwardly curving contour which is shaped to fit the corners of the particular containers being processed. The contoured surface faces inwardly and is adjusted to match the corner configuration of the container C.

Figure 2:
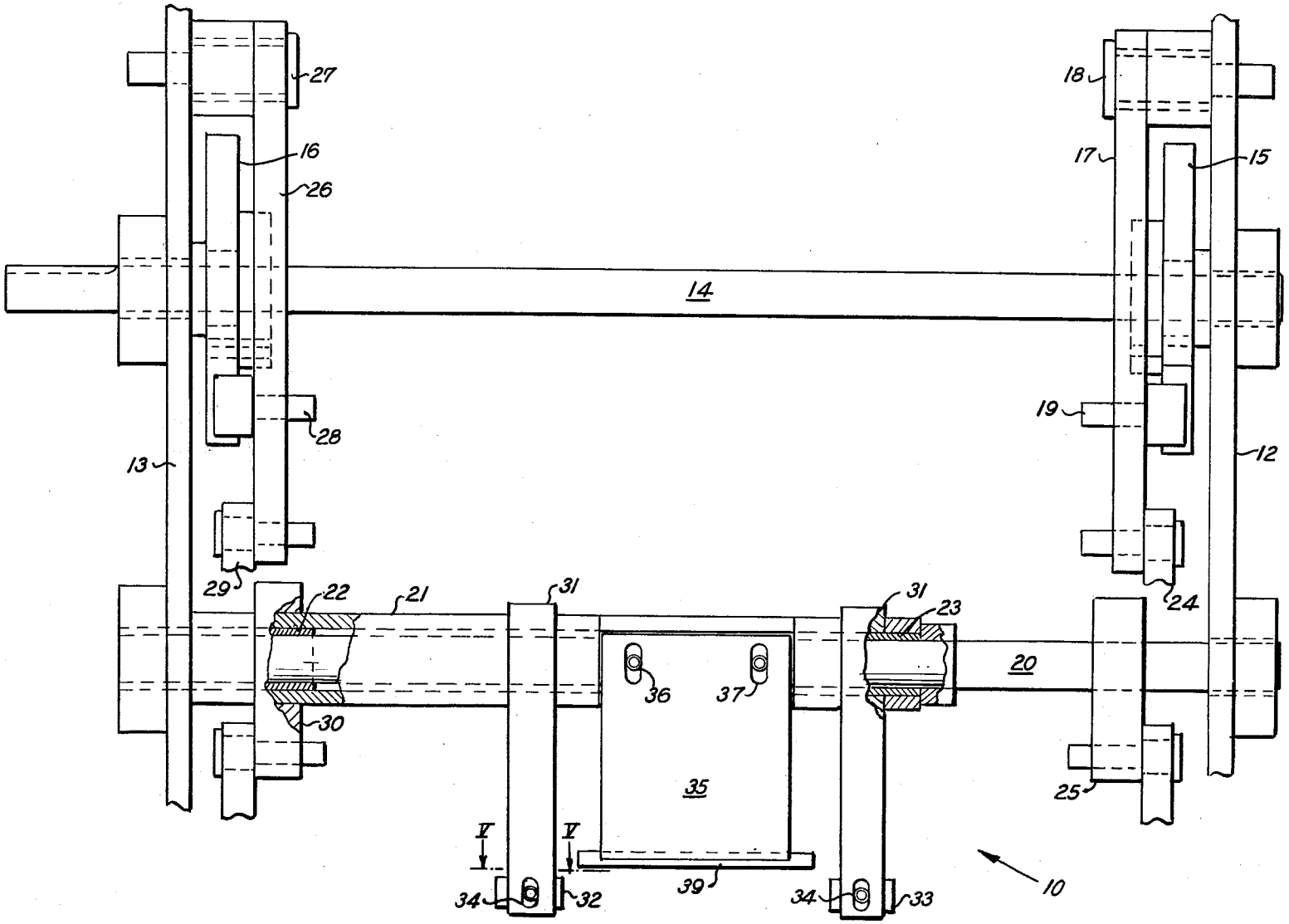
FIG. 2 is an elevational view along the line II—II of FIG. 1.

The folding element 35 is adjustably attached to the shaft 20 which is rotatably mounted within the hollow tucking shaft 21. A portion of the shaft 21 is cut away to expose the shaft 20. A fastening device 36 is used to connect the element 35 through the slots 37. The portion of the shaft 20 may be flattened to provide a base contact area for the folding element 35. A lip portion 38 located at the outer end of the folding element 35 carries an elongated folding bar 39. The length of the bar 39 is generally arranged to coincide with the width between the tuckers 32 and 33. The tucker elements 31 and folding element 35 may be driven between a resting position and a related working position through the use of a cam and follower mechanism, as shown in detail in FIG. 2. The cam and drive mechanism used to drive the separated tucker elements 31 and folding elements 35 is similar to that shown in U.S. Pat. No. 3,116,580. A drive shaft 14 is rotatably mounted in suitable bearings within the frame members 12 and 13. A folding element cam 15 is mounted at end end of the drive shaft 14 and a tucking element cam 16 is mounted at the other end of the drive shaft 14. The cams 15 and 16 are suitably designed to effectuate the desired reciprocating motion for the folding element 35 and tucking elements 31, respectively.

A cam follower 19 is rotatably mounted on the cam follower arm 17. Suitable biasing means (not shown) is provided to maintain the follower 19 in contact with the surface of the cam 15. The cam follower arm 17 is pivotally mounted on pivot pin 18 and is laterally spaced from the side frame member 12. The folding shaft 21 is rotatably mounted in suitable bearings to the side frames 12 and 13. A tucking shaft 21 is in the form of a hollow sleeve and is mounted over the folding shaft 20. The tucking shaft 21 is arranged to freely rotate about folding shaft 20 on bearings 22 and 23. The tucking shaft 21 has a length sufficient to locate the tucking elements 31 along opposite sides of the rim portions of a container C. A link mechanism 24 is pivotally connected to a clamping device 25 attached to the folding shaft 20. Movement of the follower arm 17 effectuates the pivotal movement of the link mechanism 24 to rotate the shaft 20 about its axis of rotation. When the cam 15 rotates, a reciprocating motion is imparted to the follower arm 17 as the cam follower 19 follows the cam surface. The reciprocating motion of the follower arm 17 imparts an oscillating motion to the shaft 20 thereby moving the folding element between a resting position and a folding position.

Similarly, a follower arm 26 is pivotally mounted on pivot pin 27 and is spaced from the side frame member 13. A follower member 28 mounted on the follower arm 26 is held in continuous contact with the surface of a cam by a biasing device (not shown). A link mechanism 29 pivotally connects the follower arm 26 to a clamp member 30 that is fixedly secured to the outer surface of the tucking shaft 21. Rotation of the cam 16 imparts a reciprocating motion to the follower arm 26 as in the case of the follower arm 17. Reciprocation of the arm 26 transmits an oscillating angular motion to the shaft 21 thereby moving the tucking elements between a resting position and a tucking position.

In this embodiment, the folding shaft 20 and tucking shaft 21 are mounted in coaxial relationship. It has been found that the use of the coaxial relationship simplifies design of the tucking and folding mechanism when adapting the tucking and folding elements to various sized containers.

Figure 6:
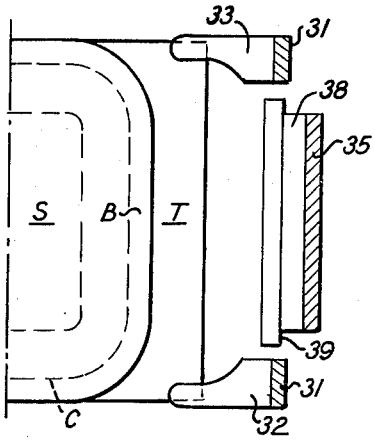
Figure 7:
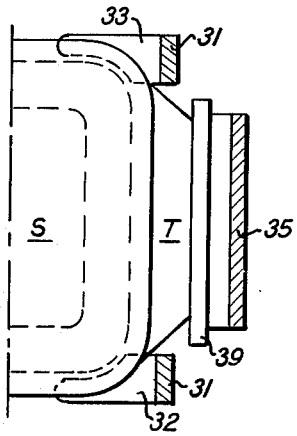
Figure 8:
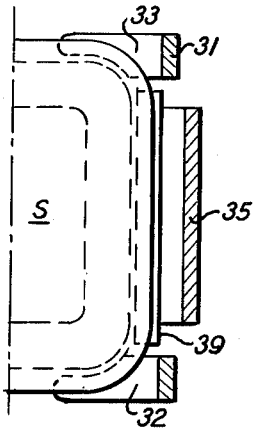

As shown in FIGS. 6 through 8, the tucking elements 31 are rotated downwardly and are timed to clear the corners of the container C. As the contoured surfaces of the tuckers 32 and 33 clear the corner of the container C, the trailing edge T is folded downwardly and under the surface of the rim portion E. The folding element 35 swings downwardly to contact the trailing edge T with the folding bar 39. In this manner, the folding element 35 acts on the trailing edge T along the trailing rim portion E between the tucker elements 31.

Figure 3:
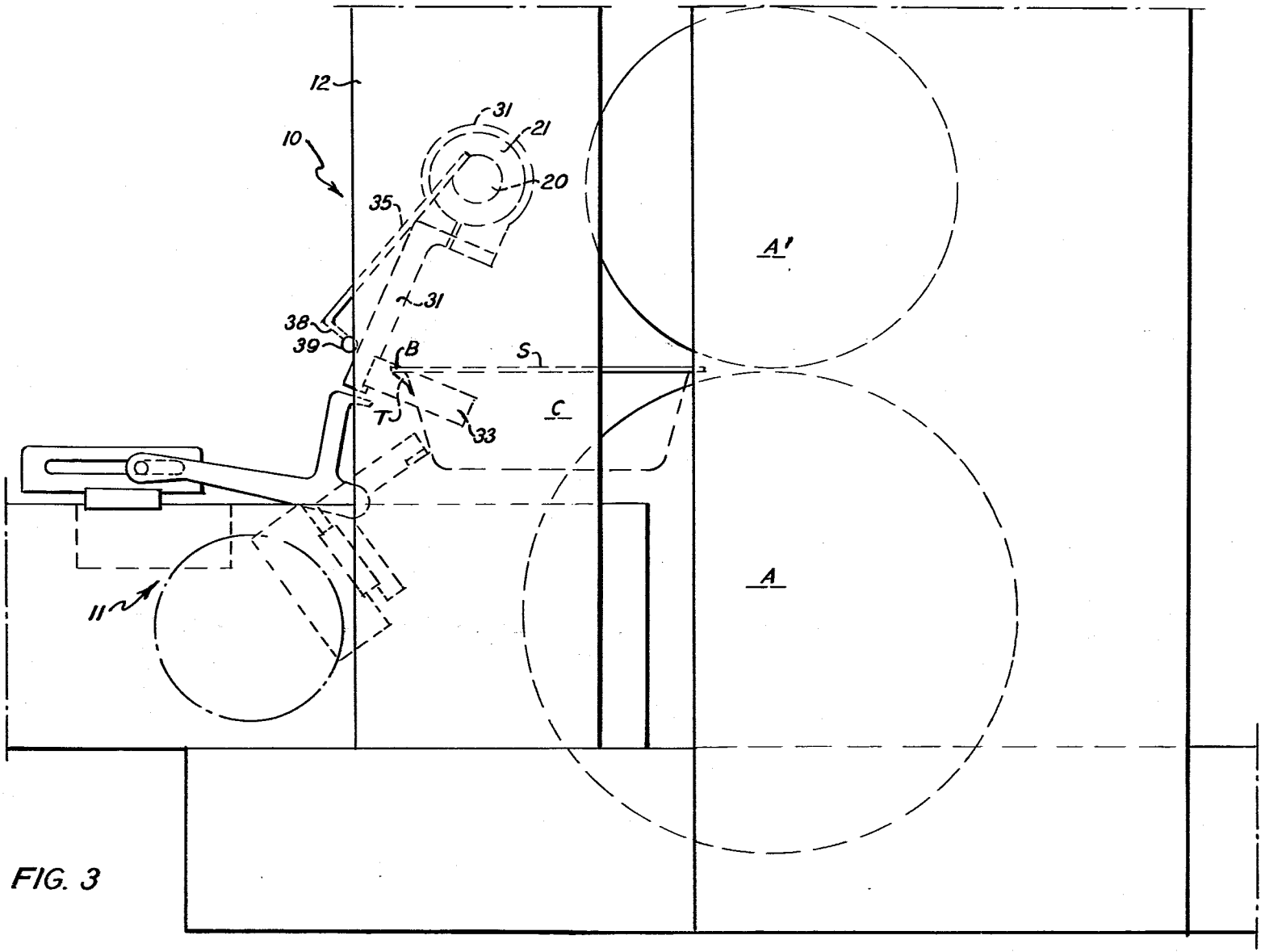
FIG. 3 is a side elevational view schematically showing the closure mechanism of FIG. 1 in a work position.

The operation of the mechanism as described herein may be summarized as follows. A tray container C having a cover sheet S is fed into a mechanism such as disclosed in U.S. Patent No. 3,116,580 and sheet S is secured under the front end and along two opposing sides of the container. Such a mechanism is depicted schematically in FIGS. 3 and 4 as crimping rollers A. The rear portion T of the flexible cover sheet trails behind a tray or container C as it is fed into such a mechanism.

The trailing edge T is first engaged by the contoured tucking members 32 and 33 as shown in FIG. 6. The members 32 and 33 form a first fold at the corners of the tray container C on opposed sides thereof. Subsequently, the folding bar 39 engages the remaining portion of the trailing edge T of the cover sheet S and folds it beneath the trailing rim B of the container. An extremely neat fold is effectuated and each tray is treated with substantial uniformity. The sequential operation of the separate tucking members 32 and 33 and the folding bar 39 is shown in FIGS. 6–8. After the final fold has been performed around and beneath the trailing rim portion E, the sheet folds are subsequently engaged and pressed in any prior art manner such as shown in U.S. Pat. No. 3,116,580.

While the closure mechanism for food tray covers has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. An apparatus for feeding a rimmed container having a flexible cover sheet folded around a leading rim portion and two opposing side rim portions, comprising:

a. means for tucking a trailing edge of the cover sheet beneath the trailing rim portion of the container to form a tucked portion along each of the opposed side rim portions, b. means for folding the remaining portion of the trailing edge of the cover sheet beneath the trailing rim portion of the container to form a neatly folded portion contiguous to each tucked portion, c. said folding means acting along the trailing rim portion between said tucking means and sequentially at a different period of time than the tucking means.

2. An apparatus as defined in claim 1 wherein said tucking means includes two separate tucking elements laterally displaced with respect to each other and means to reciprocate said tucking elements between a resting position and a tucking position.

3. An apparatus as defined in claim 1 wherein said folding means includes a single folding element and means to reciprocate said folding element between a resting position and a folding position.

4. An apparatus as defined in claim 1 wherein said tucking means includes two separate elements laterally displaced with respect to each other and means to reciprocate said elements between a resting position and a tucking position, said folding means includes a single folding element and means to reciprocate said folding element between a resting position and a folding position.

5. An apparatus as defined in claim 4 wherein said tucking elements and said folding element are pivotally mounted about the same axis of rotation.

6. An apparatus as defined in claim 1 wherein means is provided for supporting and feeding a loaded, rimmed container having a flexible cover sheet folded around a leading rim portion and two opposing side rim portions, said supporting and feeding means including feed rollers being rotatably mounted and disposed one above the other, means for rotating the feed rollers in opposite directions with respect to each other to feed the covered container therebetween, and means carried by one of the feed rollers for crimping the folded edges beneath the rim portions of the container while being fed therebetween.

* * * * *